United States Patent [19]

Powell

[11] 4,167,865

[45] Sep. 18, 1979

[54] HAND-OPERATED BENDER APPARATUS

[75] Inventor: Francis R. Powell, Naugatuck, Conn.

[73] Assignee: Mark Eyelet and Stamping, Inc., Wolcott, Conn.

[21] Appl. No.: 846,519

[22] Filed: Oct. 28, 1977

[51] Int. Cl.[2] ..... B21D 7/024

[52] U.S. Cl. ..... 72/217; 72/155; 269/228

[58] Field of Search ..... 72/149, 217, 219, 319, 72/321, 388, 459, 155; 140/102, 102.5; 81/375, 382, 367

[56] References Cited

U.S. PATENT DOCUMENTS

| | | | |
|---|---|---|---|
| 99,678 | 2/1870 | Coleman | 72/149 |
| 2,651,959 | 9/1953 | Harrington | 269/228 X |
| 3,172,452 | 3/1965 | Bryant | 72/388 |
| 3,901,064 | 8/1975 | Jacobson | 72/219 |

*Primary Examiner*—Milton S. Mehr

*Attorney, Agent, or Firm*—H. Gibner Lehmann; K. Gibner Lehmann

[57] ABSTRACT

A hand-operated bender apparatus for forming relatively thin metal stock into parts having predetermined shapes, comprising a base, a clamp on the base for holding portions of the metal stock to be shaped, and a elongate handle which is pivotally carried on the base and which can swivel about an axis thereon. The handle carries a spring-biased slide member on which there is mounted a transverse, upstanding pin constituting a shoulder adapted for engagement with the metal stock. The clamp is in the form of a vise having a fixed jaw constituted as a die, around which the metal stock is formed. The slide member is normally biased toward the pivotal axis of the handle but can yield outwardly in a direction away from such axis as the handle is swiveled, this occurring under the action of forces transmitted through the metal stock as it is being formed. The yieldable shoulder on the handle permits the use of dies having irregular shapes. Such dies can be of elliptical configuration, or alternately can have the shape of a modified cylinder or various other curved or angular prisms. With the arrangement provided, great flexibility and versatility are realized in the performing of specialized bends. In addition, rapid installation and removal of the part being formed is facilitated, thereby resulting in savings of both time and effort.

26 Claims, 14 Drawing Figures

Fig. 4
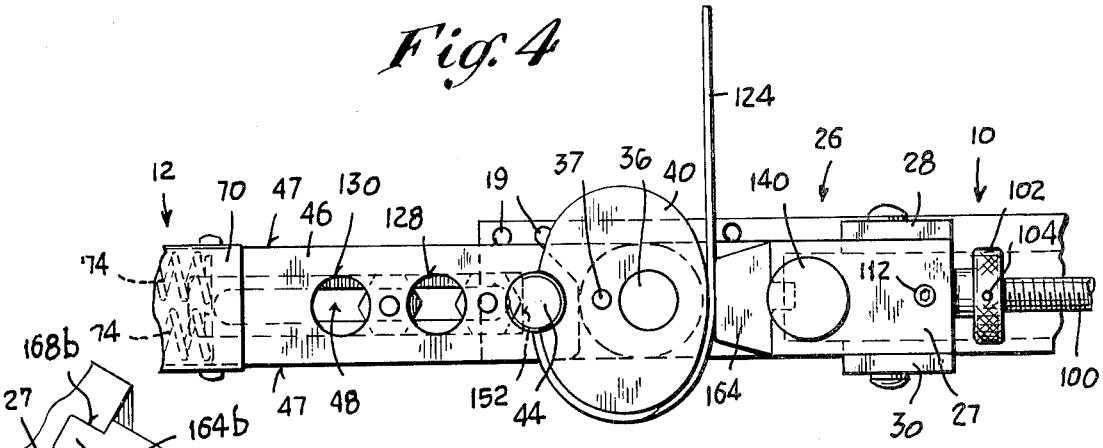
Fig. 14
Fig. 5
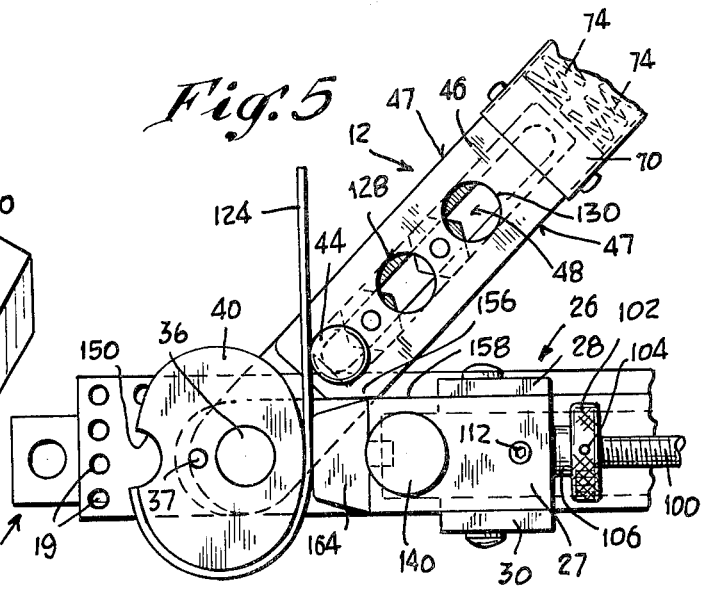
Fig. 6
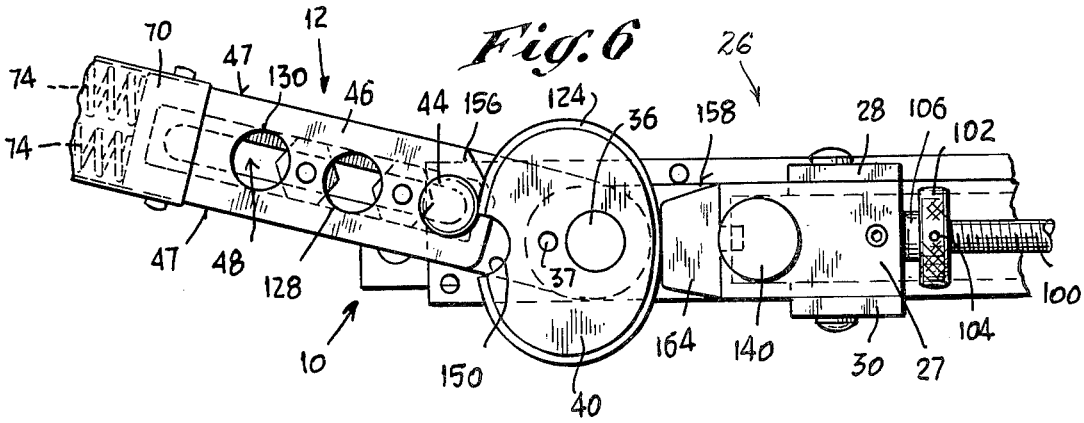

HAND-OPERATED BENDER APPARATUS

BACKGROUND

This invention relates generally to small bend-forming tools, and more particularly to manually operable bender devices of the type especially adapted to impart any of a number of predetermined shapes to pieces of relatively thin metal stock.

In the past, numbers of tools for performing a variety of bending operations have been proposed and produced, and have met with varying degrees of success.

One such prior construction is shown and described in U.S. Pat. No. 3,901,064 dated Aug. 26, 1975. The device disclosed therein involves a bender apparatus having a handle which can swivel about a pivotal axis on a base, a bend-forming die, and a vise having two jaws, one of which is movable and the other of which is fixed. While this patented device has been found to perform in a generally acceptable manner, it has several limitations, particularly as far as ease of operation is concerned when it is desired to perform certain specialized bending operations quickly, such as those involving the formation of elliptical or modified cylindrical shapes for bracelets, jewelry and the like.

In particular, in the patented device the work-engaging shoulder on the handle was constituted as an upstanding pin which was restricted to movement with the handle along a path of constant radius about the pivotal axis. As clearly illustrated in FIG. 7 of the patent, this pin was disposed a substantial distance from the die; as a result, the overall length of the stock had to be sufficient to insure its continued engagement with the pin during the bend forming process, with any excess material usually being trimmed off after the bend was fully completed. This resulted in considerable additional expense, due to the extra operations involved. Also, where gold or silver articles such as bracelets were being formed, the value of the stock was such that it was uneconomical to merely discard the trimmed off material.

In cases where a die having an irregular shape was being employed, difficulty was often encountered in completing the last phase of the bend, since the location of the shoulder or pin on the handle was such that it was unable to guide and follow the metal at its free end. Accordingly, after a certain point in the bend-forming procedure was reached, the clamp was loosened and the metal stock re-positioned with respect to the shoulder of the handle. Such re-positioning of the stock represented an additional step in the manufacture of the item, sometimes adding significantly to the overall cost thereof.

Where resilient metals having a high degree of springiness were being formed, there was a pronounced tendency for the metal to return somewhat toward its original shape after the handle was backed off. Accordingly, with springy materials the bending operation tended to be more difficult and time-consuming.

Another disadvantage of the prior art device was that the steps of clamping the workpiece in a first position and thereafter re-positioning it as necessary proved to be time-consuming, especially where a large number of individual parts was being processed. Although the disclosed arrangement was satisfactory from the standpoint of adequately clamping the parts and holding them in a stationary position, the time and effort involved in manual operation of the vise proved to be excessive, and this constituted an obstacle to the rapid completion of jobs.

SUMMARY

The above disadvantages and drawbacks of prior bender devices are obviated by the present invention, which has for an object the provision of a novel and improved bender apparatus which is especially simple in its construction, reliable and rugged in use, and which can be easily fabricated from readily available materials.

Yet another object of the invention is the provision of an improved bender apparatus as above, which can impart to a workpiece a wide variety of bends of different configurations, usually in one or two simple steps, without tne need for special fixtures or the like.

Yet another object of the invention is the provision of a bender device as above characterized, which enables strips of metal stock to be cut to a predetermined length first, and then positioned in the bender and formed to their final configuration in one or two simple operations, thereby eliminating the need for multiple re-positioning steps, and eliminating the need for performing a trimming or finishing operation on the part after it has been formed.

As a result, bends can be made more readily, with a higher degree of precision and accuracy, since the likelihood of errors due to operator-related judgment is substantially reduced.

Still another object of the invention is the provision of a bender apparatus as above set forth, wherein the workpiece can be very quickly and easily clamped in position on the bender and subsequently removed therefrom, all with a minimum amount of time and effort being required on the part of the operator.

The above objects are accomplished by the provision of a novel and improved bend-forming handle adapted to be used with benders of the kind provided with a base and clamping means thereon for holding a workpiece. The handle comprises an elongate handle body having a hand grip at one end, and means pivotally mounting the body on the base of the bender to swivel about a pivotal axis thereon. A bend-forming shoulder is carried on and movable longitudinally along the handle body in directions toward and away from the pivotal axis, and is adapted for engagement with the free ends of the workpieces as they are being formed. Spring means carried by the handle body biases the shoulder toward the pivotal axis and enables it to yield under reactive force from the workpiece and to shift in directions away from the axis as the handle body is swiveled thereabout. The arrangement is such that specialized bends can be imparted to a workpiece with only one or two operation being involved, resulting in simplified manufacturing procedures and reduced assembly time.

The above object are further accomplished by the provision, in an apparatus for bending metal parts into predetermined shapes, of a unique combination comprising a base, a vise carried by the base and having a pair of jaws, and means mounting one of the jaws for sliding movement with respect to the base, there being a plunger movable over the base and operated by an adjustable linkage connecting the movable jaw and plunger, for very quickly effecting the desired adjustable positioning and clamping. Manually-operable toggle means on the base are connected with the plunger for effecting powerful advancing movement of both the plunger and the movable jaw along a path toward the other jaw, for clamping the metal stock therebetween. The arrangement is such that a series of similar workpieces can be accurately clamped in place in the vise, formed to the desired shape and thereafter released, with a minumum of time and effort being involved. Reduced bending costs are thereby realizeable.

Other features and advantages will hereinafter appear.

In the drawings, illustrating several embodiments of the invention:

FIG. 4 is a view like FIG. 2, showing the handle swiveled to another intermediate position wherein the shoulder thereof is received in a recess in the die, thereby enabling the shoulder to be momentarily removed and the handle thereafter swiveled to the position of FIG. 5 in readiness for performing the next bending operation.

FIG. 5 is a view like FIG. 2, showing the handle swiveled to an oppositely disposed extreme position with respect to the base, ready to commence forming of the other, free end of the workpiece.

FIG. 6 is a view like FIG. 2, showing the handle swiveled to another intermediate position, with the other free end of the workpiece having been formed around the other side surface of the elliptical die.

FIG. 14 is a fragmentary perspective view of a further modified bender apparatus, employing a vise having a jaw with a stepped clamping face, and employing a cooperable stepped, bend-forming pin, constituting still another embodiment of the invention.

Figure 1:
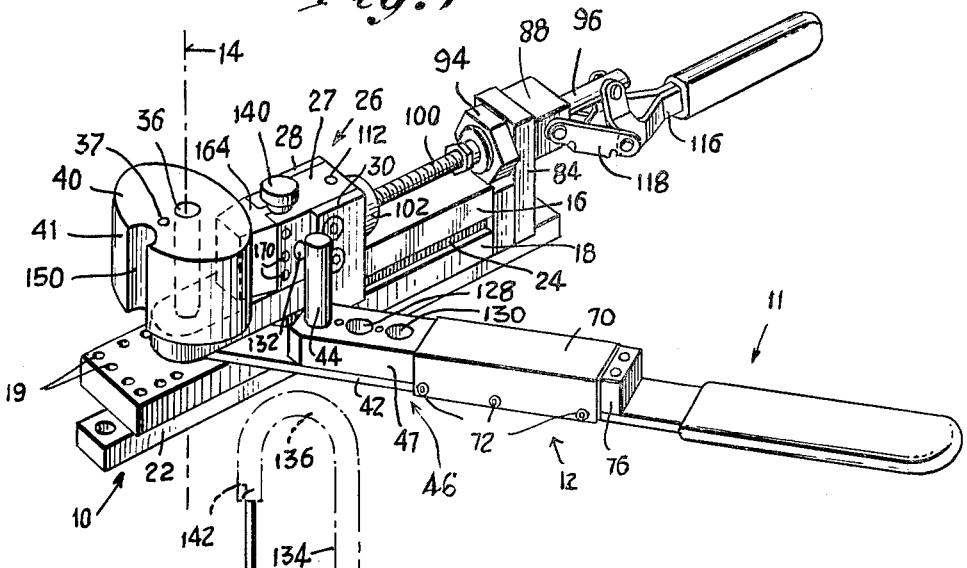
FIG. 1 is a perspective view of the improved bender apparatus of the present invention, particularly showing a base, a bend-forming handle having a shoulder in the form of a pin, and an elliptical die carried on the base.
Figure 2:
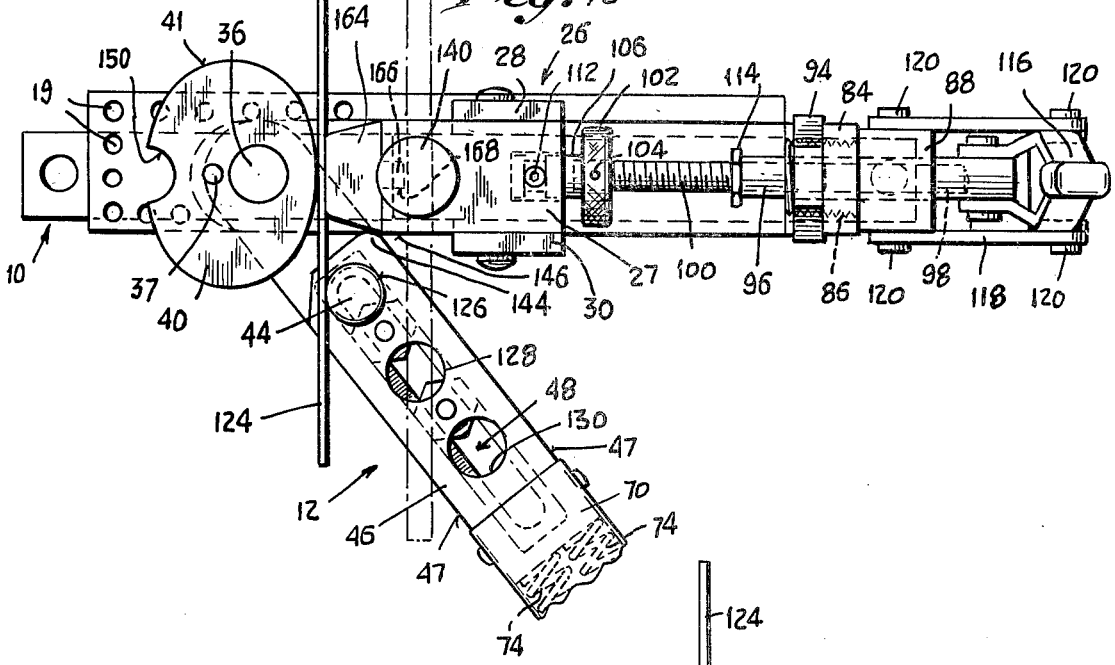
FIG. 2 is a top plan view of the bender apparatus of FIG. 1, showing the handle swiveled to an extreme position with respect to the base, wherein a slide member carried by the handle is forcibly held retracted by its engagement with a cam on the base, and wherein a workpiece is clamped for forming.
Figures 7, 8, 9, 10, 11, 12, 13:
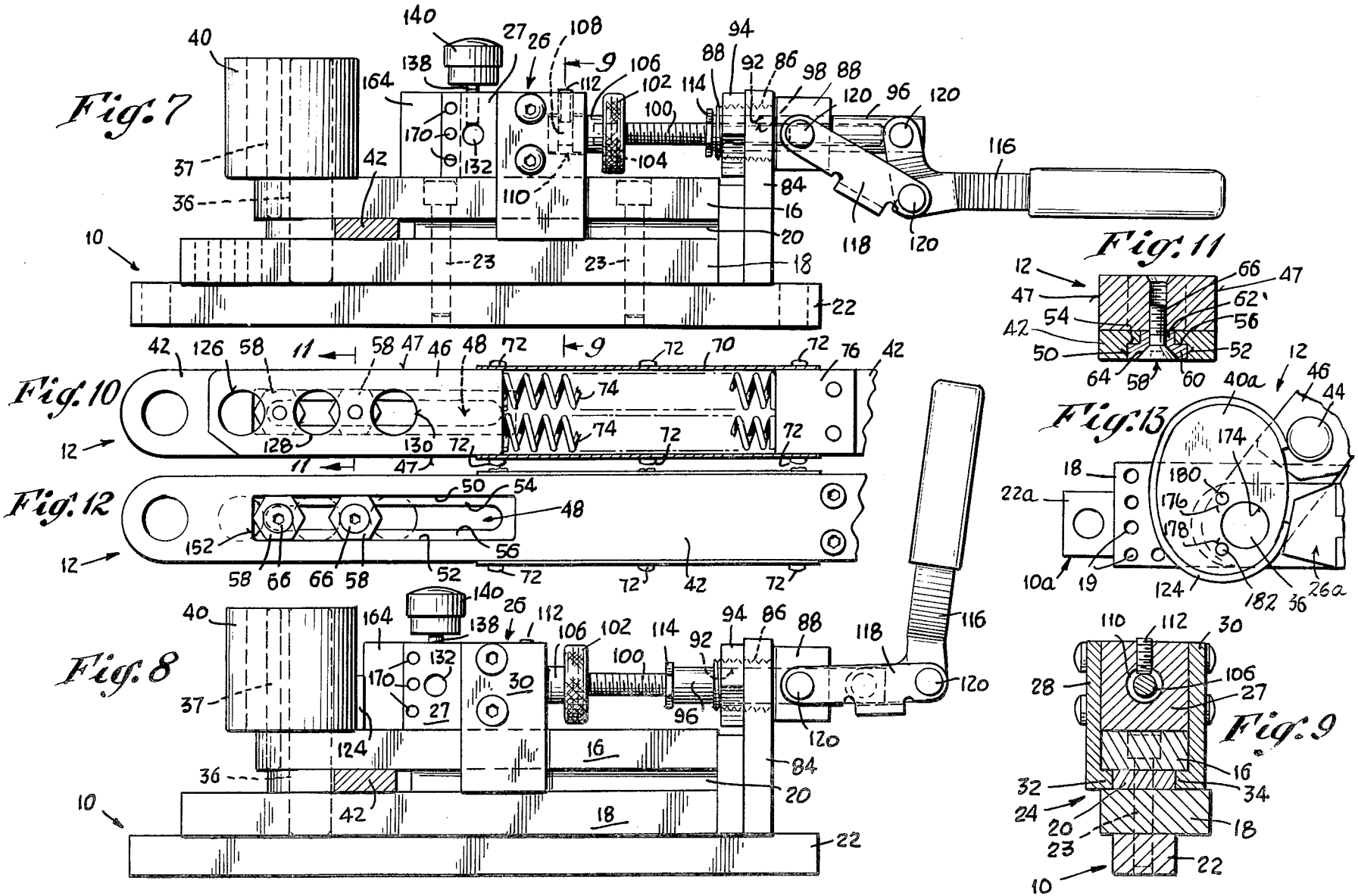
FIG. 7 is a side elevational view of the bender apparatus of FIG. 1, showing a manually operable toggle means associated with a vise carried by the base, wherein one of the vise jaws is disposed in a retracted position.
FIG. 8 is a view like FIG. 7, showing the toggle means disposed in a position wherein it has shifted the one vise jaw to an advanced position.
FIG. 9 is a section taken on line 9—9 of FIG. 7.
FIG. 10 is a fragmentary top plan view, partly in section, of the handle per se, of the apparatus of FIG. 1.
FIG. 11 is a vertical section taken on line 11—11 of FIG. 10.
FIG. 12 is a fragmentary bottom plan view of the handle per se, of the apparatus of FIG. 1.
FIG. 13 is a fragmentary top plan view of a somewhat modified bender apparatus, employing an elliptical die which is disposed off center with respect to the centerline of the base of the apparatus, and is especially adapted for forming an elliptical part in a single operation, this apparatus constituting another embodiment of the invention.

Referring first to FIG. 1 there is illustrated a bender or bending apparatus of the type intended to form small metal pieces into predetermined shapes, the apparatus comprising basically a base 10 and a bend-forming handle 12 having a hand-grip portion 11 at its end, the handle being pivotally carried by the base 10 and being capable of swiveling about a pivotal axis 14. The base 10 comprises two elongate coextensive plates 16, 18 which are maintained in spaced relation by means of a third plate 20. A series of holes 19 in the plate 20 is adapted to receive a stop pin (not shown) for limiting swiveling movement of the handle 12 between predetermined limits. An additional plate 22 is also secured to the assemblage consisting of the plates 16–20 by means of screws 23, for attaching the base to a workbench or the like. As shown, the plates 16 and 18 are slightly wider than the plate 20, thereby forming a pair of grooves 24. The base 10 carries clamping means in the form of a vise comprising a movable jaw 26 having a central support block 27 and having mounting means in the form of a pair of plates 28, 30 secured to the block 27 by suitable screws, as shown in FIGS. 1, 2 and 9. The plates 28, 30 have shoulders 32, 34 respectively, which are received in the grooves 24 such that the jaw 26 can undergo sliding movement with respect to the remainder of the base 10.

Disposed between the plates 16 and 18 is the bend-forming handle 12. A pin 36 extends through aligned apertures in the plates 16 and 18, constituting a bearing for the handle 12. In addition, an elliptical die 40 is shown, carried by the pin 36 and constituting a fixed jaw which is cooperable with the movable jaw 26 of the vise. An additional pin 37 extends through the die 40 and into an aperture in the plate 16, to key the die and prevent its rotation with respect to the plate. The lateral surface of the die is designated by the numeral 41.

In accordance with the present invention there is provided a novel handle construction incorporating a unique spring-biased, retractable shoulder which closely follows the contour of the lateral surface of the die 40 as a bend is being made, thereby to insure proper formation of the workpiece up to the extremity portions thereof, and to eliminate the necessity for removal and subsequent re-positioning thereof during the bending operation. In accomplishing this, there is provided a bend-forming shoulder on the handle 12, the shoulder being slidable with respect to an elongate handle body or body portion designated by the numeral 42. The shoulder is shown as comprising an upstanding pin or bend-forming member 44 which is removably carried by a slide member 46 having lateral or side surfaces 47. The slide member 46 is shown as being elongate, and coextensive with the handle body 42.

Referring now to FIGS. 10 and 12, cooperable guide means are provided on the handle body 42 and slide member 46 for enabling sliding movement of the latter to occur. In accomplishing this, the handle body 42 is provided with a shouldered slot 48, and the slide member 46 carries two slider pieces 58 which extend into the slot for sliding engagement with the walls thereof. As shown in FIG. 11, the slot 48 provides two pairs of track surfaces or shoulders 50, 52 and 54, 56. The slider pieces 58 are in the form of annuli having peripheral hexagonal portions 60 and hubs 62. The hexagonal portions have recesses 64 providing conical seats, and screws 66 secure the slider pieces 58 to the slide member 46 as shown. The head of each screw is received in the corresponding recess 64, such that its upper surface is substantially flush with the surface of the hexagonal portion 60 thereof. By such arrangement, the slide member 46 is held captive with respect to the handle body 42, but can undergo limited sliding movement with respect thereto, as permitted by the engagement of the opposite parallel edge surfaces of the hexagonal portion 60 with the pairs 50, 52 and 54, 56 of track surfaces of the slot 48. The hub 67 constitutes a spacer which maintains the hexagonal portions 60 in spaced relation with respect to the remainder of the slide member 46, such that a proper sliding fit occurs with the track surfaces mentioned above. In the illustrated embodiment, two such slider pieces 58 are shown in FIG. 12, spaced longitudinally from one another.

Referring again to FIGS. 1, 10 and 12, the handle body 42 carries a cover 70 which is preferably in the form of a sheet metal channel secured to opposite longitudinal edge portions of the body by means of a series of screws 72. As shown, one end of the slide member 46 is normally disposed within the one end of the cover 70, the latter thus providing a guide or slide bearing therefor.

Further in accordance with the present invention, spring means are provided for biasing the slide member 46 and shoulder or pin 44 in a direction toward the pivotal axis 14. In accomplishing this, a pair of compression coil springs 74 is provided, each of which has its one end bearing against the adjacent end of the slide member 46, and its other end engaging a block 76 constituting an abutment, which is secured to the handle body 42. As shown, the cover 70 completely conceals and confines both springs 74, while still providing a bearing to enable movement of the slide member 46 to occur.

Further, in accordance with the present invention, there is provided a novel and improved manually operable adjustable linkage and toggle means for enabling relatively rapid advancing and retracting movement of the movable jaw 26 to occur. As shown in FIGS. 7 and 8, there is disposed at one end of the base 10 an upstanding end plate 84 having an aperture 86 which receives a hollow, tubular projecting portion 88 of a mounting block 90. The projecting portion 88 is threaded externally, and is secured to the plate 84 by means of a nut 94. The bore of the projecting portion is indicated by the numeral 92; it slidably carries a plunger 96 having a hollow threaded bore 98 in which there is disposed an adjustment screw 100. One end of the screw 100 carries a manually engageable member in the form of a knurled wheel 102 which is keyed to the screw by means of a pin 104 (FIG. 2). The wheel 102 further includes a hub 106 having an annular groove 108. The hub 106 is received in a bearing 110 (FIGS. 7 and 9) in the movable jaw 26. A set screw 112 extends into the annular groove 108, thereby retaining the hub 106 and screw 100 captive against axial movement on the jaw 26, but enabling it to undergo turning movement with respect thereto. A locking nut 114 is also carried by the screw 100, for maintaining the latter in a fixed position with respect to the plunger 96 when a desired predetermined setting of the two parts has been attained, as will be explained below.

Pivotally carried at one end of the plunger 96 is a hand bar 116; a force-transmitting bar 118 is pivotally connected at its one end to the hand bar 116, and at its other end to the mounting block 90. A series of pins 120 disposed on opposite sides of the mounting block 88 effects the pivotal connection between the latter and the bar 118. Similar pins 120 effect pivotal connection of the hand bar 116 to the force-transmitting bar 118 and the plunger 96.

FIGS. 2–8 particularly illustrate the operation of the bender apparatus of the present invention. Normally the base 10 is secured to a workbench or the like (not shown) with suitable screws extending through the holes at opposite ends of the plate 22. The vise jaw 26 is movable between an advanced position with respect to the die 40 as shown in FIG. 8, and a retracted position shown in FIG. 7, merely by shifting the hand bar 116 through an arc on the order of 90°. It can be seen that this toggle arrangement involving the bars 116, 118 and plunger 96 provides a powerful advancing force to the jaw 26, with the mechanical advantage between the hand bar 116 and jaw 26 increasing as the latter approaches the die 40. The jaw 26 can thus be locked in predetermined fixed positions on the base 10. I have found that this construction is highly satisfactory from the standpoint of securely clamping a workpiece in an operative position between the jaw 26 and die 40. In some of the appended claims, the area around the die is referred to as a work-performing station.

Referring again to FIG. 8, the position of the jaw 26 relative to the die 40 can be adjusted by means of the wheel 102. The proper setting can be quickly determined by a trial and error process involving advancing the jaw 26 toward the die, with the workpiece in place. The toggle can be momentarily released as the adjustments are made. Once the proper setting has been obtained for a given stock thickness, the lock nut 114 can be tightened against the end of the plunger 88; the operator then need only shift the toggle between the positions of FIGS. 7 and 8 in order to effect either clamping or release of the workpiece.

As illustrated particularly in FIGS. 1 and 2, the slide member 46 has a series of transverse apertures 126, 128 and 130; the pin 44 can be loosely received in any one of these, depending on the dimensions of the die with which the handle 12 is to be used. In the illustrated embodiment, the pin 44 is shown occupying the aperture 126.

Referring to FIGS. 1 and 2, the jaw 26 is seen to have a transverse aperture 132 in which there is slidably carried a positioning bar 134 having a hook 136 at its end. The bar can slidably adjusted with respect to the jaw 26, and locked at a predetermined point by means of a set screw 138 (FIGS. 7, 8) having a manually engageable knob 140. The end portion 142 of the hook constitutes a positioning shoulder against which the adjacent end of a piece of strip stock 124 is adapted to bear when the latter is clamped in place, as in FIG. 2. The proper position of the bar 134 is determined experimentally, after which it serves as a guide for bending subsequent parts of similar dimensions. The bar is shown in FIG. 2, but has been omitted from the remaining figures in the interest of clarity.

In FIG. 2, with the pin 44 having been temporarily removed, the handle 12 is swiveled to a fully counterclockwise, extreme position with respect to the base 10. As this is done, the corner portion 144 of the slide member 46 is engaged by an adjacent cam surface 146 of the base, which causes a retraction of the slide member with respect to the handle body 42 against the action of the springs 74, the corner portion 144 thus constituting a cam follower. The retraction of the slide member has the effect of momentarily locating the hole 126 such that the pin 44 can be inserted therein without encountering interference from either the lateral surface 41 of the die 40, or from the workpiece 124. This is important, since the slide member, when advanced by springs 74, will urge the pin 44 into firm engagement with this lateral surface, as will be explained below. Were the slide member 46 not retractable, it would not be possible to form the part in the simple manner which will shortly be described.

Referring again to FIGS. 2 and 3, after the pin is inserted into the aperture 126, the handle 12 is swiveled about the axis 14 in a clockwise direction. It shold be noted that as soon as the handle is released from the position of FIG. 2, the springs 74 bias the slide member to an advanced position toward the pivotal axis wherein it effects the initial bending of the stock and closely follows it as it is formed around the lateral surface of the die. It can be understood that the pin moves along a path of variable radius as the handle is swung toward the position of FIG. 3, and in so doing the springs 74 yield as required, under the reactive force applied to the pin 44 by the die, acting through the workpiece; the springs 74, being quite stiff, maintain continuous engagement of the pin and the workpiece, and the latter is thus formed around the lateral surface of the die as the handle reaches the position of FIG. 3. This constitutes the end of the first bending operation. In order to proceed with the formation of the other free end of the stock 124, the pin 44 must be removed, and the handle swiveled to the position of FIG. 5. To facilitate removal, the die 40 is provided with a longitudinal recess 150 of slightly larger dimension than that of the pin 44. The handle 12 can thus be swiveled next to the position of FIG. 4, wherein the pin 44 is urged into the recess by the spring biased slide member 46.

As shown in FIG. 4, the arrangement is such that the slider piece 58 which is closest to the pivotal axis engages the end 152 of the slot 48 (FIG. 12) just before the pin 44 would normally come into engagement with the walls of the die recess 150. Thus the pin 44 is no longer wedged against the die and can be readily removed from the position of FIG. 4; the handle thereafter can be swiveled to the position of FIG. 5 in order to begin the second bending operation.

As the handle is swiveled to an extreme clockwise position with respect to the base 12 as shown in FIG. 5, the opposite corner 156 of the slide member, which is flattened somewhat, is engaged by an additional cam surface 158 on the base. The corner 156 of the slide member thus constitutes an additional cam follower. This engagement effects retraction of the slide member, and permits the pin 44 to be re-inserted in the aperture 126 without interference from either the die 40 or the remaining (straight) portion of the workpiece 124. The handle 12 is then swiveled in a counterclockwise direction to the position of FIG. 6. As this is done, the pin 44 moves along a path of variable radius, and is maintained in firm engagement with the workpiece so as to carefully form the latter to the contour of the lateral surface 41. Upon again reaching the position shown in FIG. 4, the pin 44 can be removed, and the completed part released from the vise.

The above construction is seen to have a number of very important advantages which are not enjoyed by the device of the prior art. In the case of an elliptically shaped article the bend-forming operation can be completed in two relatively simple steps, the first involving the formation of the one end of the workpiece as in FIGS. 2 and 4, and the second involving the formation of the other end of the workpiece, as in FIGS. 5 and 6. It is to be noted that with the present apparatus, no trimming of material is required following the completion of the bend. In other words, the strip stock to be formed can be first pre-cut to an accurately predetermined length, and thereafter carefully clamped in place in the present bender apparatus, using the positioning bar 134 as a guide. Following the completion of the two bends outlined above, the article is virtually finished with the exception of minor polishing or surface finishing operations which may be desired.

Figure 3:
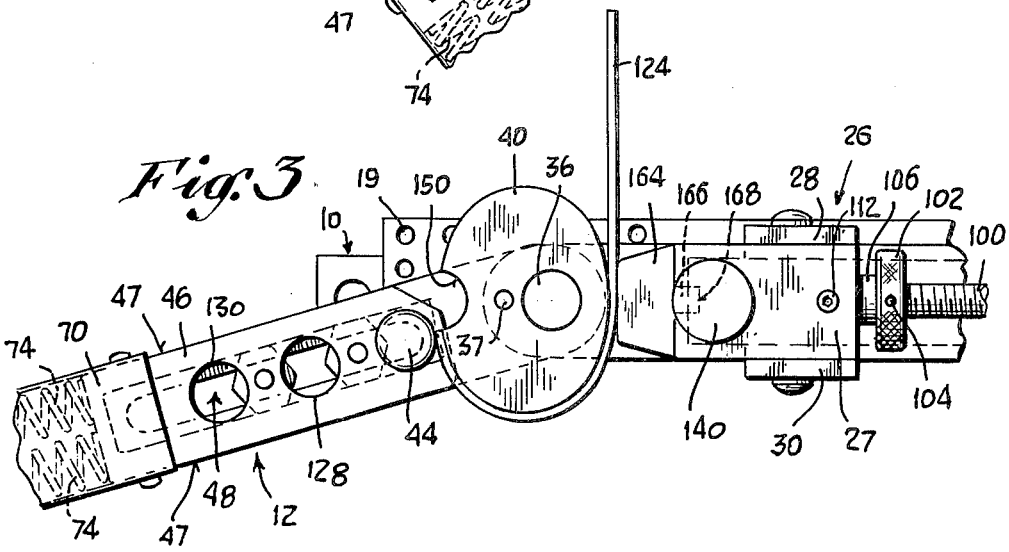
FIG. 3 is a view like FIG. 2, showing the handle swiveled to an intermediate position on the base, with the one free end of the workpiece having been formed around a side surface of the elliptical die.

By the provision of the retractable shoulder in the form of the pin 44 on the handle 12, it is possible to very carefully form a workpiece to the contours of irregularly shaped dies. It is to be especially noted that a desired shape can be imparted even to the very ends of the workpiece as illustrated in FIGS. 3 and 6. This is due to the fact that the pin 44 follows the contour of the die right up to the location of these ends, and then slides past them, thereafter dropping into the die slot 150. Thus there is minimized the tendency of the material to spring back toward the original shape after the pin 44 is removed. It is also to be noted that in the present operation, only a single clamping step is involved. In order to form such an elliptically shaped article with the prior art device, a series of clamping operations would have been required. In addition, it would not have been possible to directly form the adjacent end portions of the elliptical article without starting with an oversized piece of stock, performing a series of bending and reclamping operations, and thereafter trimming off the excess length. This would be required in order to maintain a sufficient length near the ends of the stock for insuring continued engagement by the pin on the handle as the latter was swung about the pivotal axis. Accordingly, the present device involves a much simpler procedure, with considerably less material waste and less time involved in clamping, releasing, and re-positioning the stock.

It is also to be noted that in the prior art device, each time a piece of stock was re-positioned there was a likelihood of errors being introduced into the bending operation. On the other hand, in the present construction the operator-related judgment is reduced, since there is but a single positioning step involved in the clamping of the workpiece. This clamping step is seen to be quite simple, involving a substantially straight piece of stock 124; there is thus only a remote likelihood that an incorrect or inaccurate positioning would ever occur.

Referring again to FIGS. 1–8 and in accordance with the present invention there is provided a removable face part 164 in the slidable jaw 26, for direct engagement with the article being formed. As shown, the face part has a protruding rib or tongue 166 which is receivable in a groove or slot 168 in the central support block 27. The rib 166 is engaged by a plurality of clamping screws 170 which are carried in the block 27, in order to enable a quick replacement of the face part to be made in the event that a part having a different contour is desired to be used. In the illustrated embodiment, a face part 164 having a substantially planar work-engaging surface is shown, this configuration having been found to be satisfactory for performing the bending operations described above. As can be readily understood, other face parts could be employed, having different work-engaging surface configurations.

Another embodiment of the invention is illustrated in FIG. 13, showing a somewhat modified bender apparatus comprising a base 10*a*, a bend-forming handle 12 which is substantially identical to that illustrated in FIG. 1, and a modified elliptical die 40*a*. The latter has a central aperture 174 in which the pin 36 is received, and additional adjacent keying apertures 176, 178. These respectively receive pins 180, 182 which extend into corresponding holes in the plate 18 of the base 10*a*, in order to position the die 40*a* with respect thereto and prevent relative turning movement between the two parts. As in the previous embodiment, a pin 44 is carried on the slide member 46 of the handle 12. The vise jaw 26*a* is movable over the base.

In accordance with the present invention, the die 40*a* is disposed off center with respect to the centerline of the base 10*a*. This construction is especially adapted for forming an elliptical article such as a bracelet or the like, in a single operation. As can be readily understood, the metal stock 124 to be formed is first clamped in position (while still straight) between the vise jaw 26*a* and the die 40*a*. The handle 12 is then swung from an extreme counterclockwise position, corresponding to the position shown in FIG. 2 of the previous embodiment, toward a fully clockwise position, with the pin 44 slidably engaging the workpiece 124 and yielding outwardly with slide member 46 as required by the specific contour of the die. The bend is completed when the position of FIG. 13 has been reached. It is noted that in this embodiment, as in the previous case, the article being formed is bent right up to its extremity, with no subsequent bending or re-positioning steps being required. The elliptical article can thus be formed in a single operation. Following completion of the bend, the handle 12 is momentarily urged to an extreme clockwise position wherein the engagement of the corner portion 156 of the slide member 46 and the corresponding cam surface 158 of the base effects retraction of the slide member, to enable the pin 44 to be removed. It is to be noted that in the present instance, no trimming of excess material is required, following the bend forming operation. In other words, the stock can be cut to the predetermined desired lengths first, resulting in virtually no waste, and also resulting in reduced manufacturing time.

Yet another embodiment of the invention is illustrated in FIG. 14, showing a modified bender apparatus comprising a base 10 and a handle 12 which are substantially identical to those of the first embodiment, and a vice jaw comprising a support block 27 having a groove 168*b*, and a face member 164*b* having a tongue formation 166*b*. As shown, the face member or part 164*b* has a stepped configuration, which is adapted to be used with a modified pin 36*b* also having a corresponding stepped configuration, and comprising a series of stacked cylindrical surfaces of increasing diameter. With such arrangement, an arcuate bend can be imparted to a particular workpiece merely by clamping the latter in position between the pin 44*b* and the jaw, after which additional arcuate bends can be imparted thereto by appropriate manipulation of the handle 12. The radius of curvature of the arcuate bends imparted to the workpiece, by virtue of its being clamped in the vise, can thus be made different by employing the different stepped portions of the face part 164*b* and pin 36*b*. In other respects, the operation of the embodiment shown in FIG. 14 is substantially the same as that described in connection with the first mentioned embodiment, with the exception that the pin on the handle 12 does not follow the contour of the stepped pin 36*b* but instead merely moves along a substantially constant radius about the axis thereof. Accordingly, in this construction there would normally occur no retraction of the slide member.

From the above it can be seen that I have provided novel and improved hand bender devices which are extremely simple in construction, and which have been shown to be unusually flexible from the standpoint of performing specialized bends in predetermined lengths of metal strip stock. As pointed out above, a minimum amount of re-positioning of the stock is required once a particular operation is commenced. There is thus minimized waste of material, since usually there are no extra lengths to be trimmed off after the completion of the bend. As a result, there is a substantial saving of material and reduction in overall costs. Due to the fact that minimum re-positioning of the stock is involved, the likelihood of operator-related error is reduced. Also, by virtue of the novel toggle mechanism utilized, there results in substantial time savings, since once the desired relative position between the jaw 26 and plunger 96 is obtained for a particular run of identical articles, subsequent parts can be successively clamped in position on the bender and formed to the predetermined desired shape in fairly rapid succession. While the die illustrated in connection with the first embodiment was of a generally elliptical shape, it can be readily understood that other prismatic shapes could be employed without affecting the operation of the device. The nature of the retractable slide member 46 and upstanding pin 44 is such that the latter can follow the contour of virtually any prismatic shape within the limits of movement of the slide member 46 with respect to the handle body 42. Accordingly, great flexibility is thereby realizeable.

Each of the appended claims defines a distinct aspect of the invention different from the others, and accordingly is to be treated in this manner when the prior art devices are examined in any determination of patentability or validity.

Variations and modifications are possible without departing from the spirit of the invention, and portions of the improvement may be used without others.

I claim:

1. A bend-forming handle adapted to be used with benders of the kind provided with a base and clamping means thereon for holding a workpiece, comprising in combination:

(a) an elongate handle body having a hand grip at one end, (b) means for pivotally mounting said body on the base of the bender to swivel about a pivotal axis thereon, (c) a bend-forming shoulder carried directly by said handle body and movable therewith londitudinally along the length thereof between limits, in directions toward and away from said pivotal axis, said shoulder being adapted for engagement with workpieces, (d) spring means engageable with said handle body and shoulder, biasing the latter toward said pivotal axis and enabling the shoulder to yield under reactive force from the workpiece, and to shift in a direction away from said axis as the handle body is swiveled thereabout, and (e) means movable on the handle body and connected to said shoulder, providing a camming surface adapted to engage a cooperable part on the base to effect retraction of the shoulder in response to shifting of the handle body toward one limit of its movement.

2. The invention as defined in claim 1, wherein:
(a) said bend-forming shoulder comprises a slide member, and
(b) cooperable guide means on said handle body and slide member for holding the latter captive on the body while enabling it to have limited relative sliding movement with respect thereto.

3. The invention as set forth in claim 1, wherein:
(a) said spring means comprises a compression coil spring,
(b) an abutment on said handle body, against which one end of said spring seats, and
(c) a cover on said handle body, for confining the spring and holding it in an operative position with its other end bearing against the slide member.

4. The invention as set forth in claim 1, wherein:
(a) said slide member is elongate and has a series of transverse apertures disposed respectively at different distances from the pivotal axis,
(b) said shoulder comprising a pin receivable in any one of said apertures for accomodating workpieces of different girth.

5. A bend-forming handle adapted to be used with benders of the kind provided with a base and clamping means thereon for holding a workpiece, comprising in combination:
(a) an elongate handle body having a hand grip at one end,
(b) means for pivotally mounting said body on the base of the bender to swivel about a pivotal axis thereon,
(c) a bend-forming shoulder carried directly by said handle body and movable therewith longitudinally along the length thereof between limits, in directions toward and away from said pivotal axis, said shoulder being adapted for engagement with workpieces,
(d) spring means engageable with said handle body and shoulder, biasing the latter toward said pivotal axis and enabling the shoulder to yield under reactive force from the workpiece, and to shift in a direction away from said axis as the handle body is swiveled thereabout,
(e) said bend-forming shoulder comprising a slide member, and
(f) cooperable guide means on said handle body and slide member for holding the latter captive on the body while enabling it to have limited relative sliding movement with respect thereto,
(g) said cooperable guide means comprising a cover carried by said handle body,
(h) said cover being engageable with lateral surfaces of said slide member and constituting a slide bearing therefor.

6. A bend-forming handle adapted to be used with benders of the kind provided with a base and clamping means thereon for holding a workpeice, comprising in combination:
(a) an elongate handle body having a hand grip at one end,
(b) means for pivotally mounting said body on the base of the bender to swivel about a pivotal axis thereon,
(c) a bend-forming shoulder carried directly by said handle body and movable therewith longitudinally along the length thereof between limits, in directions toward and away from said pivotal axis, said shoulder being adapted for engagement with workpieces,
(d) spring means engageable with said handle body and shoulder, biasing the latter toward said pivotal axis and enabling the shoulder to yield under reactive force from the workpiece, and to shift in a direction away from said axis as the handle body is swiveled thereabout,
(e) said bend-forming shoulder comprising a slide member, and
(f) cooperable guide means on said handle body and slide member for holding the latter captive on the body while enabling it to have limited relative sliding movement with respect thereto,
(g) said slide member being elongate and slidable in a longitudinal direction on the handle body,
(h) said cover comprising a sheet metal channel secured to the body along opposite longitudinal edge portions thereof.

7. A bend-forming handle adapted to be used with benders of the kind provided with a base and clamping means thereon for holding a workpiece, comprising in combination:
(a) an elongate handle body having a hand grip at one end,
(b) means for pivotally mounting said body on the base of the bender to swivel about a pivotal axis thereon,
(c) a bend-forming shoulder on and movable longitudinally along said handle body in directions toward and away from said pivotal axis, said shoulder being adapted for engagement with workpieces,
(d) spring means engageable with said handle body and shoulder, biasing the latter toward said pivotal axis and enabling the shoulder to yield under reactive force from the workpiece, and to shift in a direction away from said axis as the handle body is swiveled thereabout,
(e) said bend-forming shoulder comprising a slide member,
(f) cooperable guide means on said handle body and slide member for holding the latter captive on the body while enabling it to have limited relative sliding movement with respect thereto,
(g) said handle body having a slot constituting said cooperable guide means, and
(h) a slider piece carried by said slide member and extending into said slot for sliding engagement with the walls thereof.

8. A bend-forming handle adapted to be used with benders of the kind provided with a base and clamping means thereon for holding a workpiece, comprising in combination:
(a) an elongate handle body having a hand grip at one end,
(b) means for pivotally mounting said body on the base of the bender to swivel about a pivotal axis thereon,
(c) a bend-forming shoulder on and movable longitudinally along said handle body in directions toward and away from said pivotal axis, said shoulder being adapted for engagement with workpieces,
(d) spring means engageable with said handle body and shoulder, biasing the latter toward said pivotal axis and enabling the shoulder to yield under reactive force from the workpiece, and to shift in a direction away from said axis as the handle body is swiveled thereabout, (e) said bend-forming shoulder comprising a slide member, (f) cooperable guide means on said handle body and slide member for holding the latter captive on the body while enabling it to have limited relative sliding movement with respect thereto, (g) said handle body having a shouldered slot constituting part of said cooperable guide means, and (h) a slider piece carried by said slide member and extending into said slot, (i) said shouldered slot providing two independent track surfaces for engagement by said slider piece.

9. The invention as defined in claim 8, wherein:

(a) said track surfaces are disposed generally perpendicular to one another, (b) the engagement of the slider piece with said two track surfaces minimizing lateral shifting in two directions of the slide member with respect to the handle body.

10. A bend-forming handle adapted to be used with benders of the kind provided with a base and clamping means thereon for holding a workpiece, comprising in combination:

(a) an elongate handle body having a hand grip at one end, (b) means for pivotally mounting said body on the base of the bender to swivel about a pivotal axis thereon, (c) a bend-forming shoulder on a movable longitudinally along said handle body in directions toward and away from said pivotal axis, said shoulder being adapted for engagement with workpieces, (d) spring means engageable with said handle body and shoulder, biasing the latter toward said pivotal axis and enabling the shoulder to yield under reactive force from the workpiece, and to shift in a direction away from said axis as the handle body is swiveled thereabout, (e) said bend-forming shoulder comprising a slide member, (f) cooperable guide means on said handle body and slide member for holding the latter captive on the body while enabling it to have limited relative sliding movement with respect thereto, (g) said handle body having a shouldered slot constituting said cooperable guide means, and (h) a slider piece carried by said slide member and extending into said slot, (i) said slot providing two pairs of independent track surfaces for engagement by said slider piece.

11. The invention as set forth in claim 10, wherein:

(a) said slider piece comprises an annulus having a hexagonal portion, (b) opposite edge surfaces of said hexagonal portion being respectively engageable with the two pairs of track surfaces.

12. The invention as set forth in claim 11, wherein:

(a) said hexagonal portion has a recess constituting a seat, (b) a screw carried by said slide member and securing the slider piece thereto, (c) the head of the screw being received in said seat.

13. The invention as set forth in claim 10, wherein:

(a) said slider piece comprises an annulus having a hexagonal portion and a hub, (b) said hub constituting a spacer between the hexagonal portion and slide member to provide a clearance space in which the shoulders of the slot are received.

14. A bend-forming handle adapted to be used with benders of the kind provided with a base and clamping means thereon for holding a workpiece, comprising in combination:

(a) an elongate handle body having a hand grip at one end, (b) means for pivotally mounting said body on the base of the bender to swivel about a pivotal axis thereon;

(c) a bend-forming shoulder on and movable longitudinally along said handle body in directions toward and away from said pivotal axis, said shoulder being adapted for engagement with workpieces, (d) spring means engageable with said handle body and shoulder, biasing the latter toward said pivotal axis and enabling the shoulder to yield under reactive force from the workpiece, and to shift in a direction away from said axis as the handle body is swiveled thereabout, (e) means on said base defining a cam surface, and (f) a cam follower on said slide member, engaging said cam surface as the handle is swiveled toward one extreme position thereof with respect to the base, (g) swiveling of said handle toward said position effecting limited retraction of said slide member in a direction away from said pivotal axis to provide increased clearance space between said bend-forming shoulder and portions of the base to enable free positioning of a workpiece therebetween.

15. The invention as set forth in claim 14, wherein:

(a) said cam follower comprises a corner portion at that end of the slide member which is closest to the pivotal axis.

16. The invention as set forth in claim 14, and further including:

(a) an additional cam on said base, (b) an additional cam follower on said slide member, engageable with said additional cam as the handle is swiveled to an opposite extreme position with respect to the base, (c) swiveling of said handle toward said second position effecting limited retraction of said slide member in a direction away from said pivotal axis to provide increased clearance space between said bend-forming shoulder and portions of the base to enable a workpiece carried therein to be readily released.

17. A bend-forming handle adapted to be used with benders of the kind provided with a base and clamping means thereon for holding a workpiece, comprising in combination:

(a) an elongate handle body having a hand grip at one end, (b) means for pivotally mounting said body on the base of the bender to swivel about a pivotal axis thereon, (c) a bend-forming shoulder on and movable longitudinally along said handle body in directions toward and away from said pivotal axis, said shoulder being adapted for engagement with workpieces, (d) spring means engageable with said handle body and shoulder, biasing the latter toward said pivotal axis and enabling the shoulder to yield under reactive force from the workpiece, and to shift in a direction away from said axis as the handle body is swiveled thereabout,
(e) said spring means comprising a compression coil spring,
(f) an abutment on said handle body, against which one end of said spring seats, and
(g) a cover on said handle body, for confining the spring and holding it in an operative position with its other end bearing against the slide member,
(h) said cover comprising a sheet metal channel secured to the handle body,
(i) one end of said slide member being receivable in the end of said channel,
(j) said spring being completely concealed by the cover and by a portion of said one slide member.

18. An apparatus for bending metal parts into predetermined shapes, comprising in combination:
(a) a base,
(b) a vise carried by the base, said vise having a pair of jaws,
(c) means mounting one of said jaws for sliding movement with respect to the base,
(d) a plunger and means movably mounting the same on the base,
(e) adjustable linkage means connecting said movable jaw and plunger, for adjustably positioning the latter with respect thereto,
(f) manually-operable toggle means carried by said base and connected with said plunger, for effecting powerful advancing movement of the plunger and movable jaw along a path toward the other jaw to clamp a metal part therebetween,
(g) said plunger having a hollow threaded bore,
(h) said linkage means comprising a screw received in the threaded bore,
(i) manually engageable means carried by said screw, for effecting turning of the same with respect to the plunger, and
(j) a bearing on said movable jaw, turnably mounting one end of said screw,
(k) said bearing preventing relative axial movement of said screw with respect to said jaw.

19. An apparatus for bending metal parts into predetermined shapes, comprising in combination:
(a) a base,
(b) a vise carried by the base, said vise having a pair of jaws,
(c) means mounting one of said jaws for sliding movement with respect to the base,
(d) a plunger and means movably mounting the same on the base,
(e) adjustable linkage means connecting said movable jaw and plunger, for adjustably positioning the latter with respect thereto,
(f) manually-operable toggle means carried by said base and connected with said plunger, for effecting powerful advancing movement of the plunger and movable jaw along a path toward the other jaw to clamp a metal part therebetween,
(g) said plunger having a hollow threaded bore,
(h) said linkage means comprising a screw received in the threaded bore,
(i) manually engageable means carried by said screw, for effecting turning of the same with respect to the plunger,
(j) said toggle means comprising a hand bar pivotally carried on said plunger, and
(k) a force-transmitting bar pivotally connected at one end with said hand bar and pivotally connected at its other end with said base.

20. An apparatus for bending metal parts into predetermined shapes, comprising in combination:
(a) a base,
(b) a vise carried by the base, said vise having a pair of jaws,
(c) means mounting one of said jaws for sliding movement with respect to the base,
(d) a plunger and means movably mounting the same on the base,
(e) adjustable linkage means connecting said movable jaw and plunger, for adjustably positioning the latter with respect thereto,
(f) manually-operable toggle means carried by said base and connected with said plunger, for effecting powerful advancing movement of the plunger and movable jaw along a path toward the other jaw to clamp a metal part therebetween,
(g) said plunger having a hollow threaded bore,
(h) said linkage means comprising a screw received in the threaded bore, and
(i) manually engageable means carried by said screw, for effecting turning of the same with respect to the plunger,
(j) said manually-operable toggle means comprising a device for locking the plunger in a predetermined fixed position with respect to said base.

21. An apparatus for bending metal parts into predetermined shapes, comprising in combination:
(a) a base,
(b) clamping means on the base for holding, at a work-performing station thereon, metal stock to be bent,
(c) an elongate handle, comprising a body portion,
(d) means pivotally mounting the handle body portion on the base for swiveling movement about a pivotal axis adjacent to said work-performing station,
(e) a bend-forming shoulder carried directly by said handle body portion and movable therewith longitudinally along the length thereof between limits, in directions toward and away from said pivotal axis, said shoulder being adapted for engagement with the workpiece,
(f) spring means engageable with said handle body portion and said shoulder, biasing the latter toward said pivotal axis, thereby enabling the shoulder to yield under reactive force from the workpiece, and to shift in directions away from said axis as the handle body portion is swiveled thereabout, and
(g) means movable on the handle body portion and connected to said shoulder, providing a camming surface adapted to engage a cooperable part on the base to effect retraction of the shoulder in response to shifting of the handle body portion toward one limit of its movement.

22. The invention as set forth in claim 21, wherein:
(a) said clamping means comprises a vise having a pair of jaws,
(b) one of said jaws comprising a pin carried by the base, and (c) a die carried by said pin and having lateral surface areas adapted to engage a workpiece as it is being bent, so as to impart a predetermined shape thereto.

23. The invention as set forth in claim 22, wherein:

(a) said lateral surface areas are elliptical.

24. An apparatus for bending metal parts into predetermined shapes, comprising in combination:

(a) a base, (b) clamping means on the base for holding, at a work-performing station thereon, metal stock to be bent, (c) an elongate handle, comprising a body portion, (d) means pivotally mounting the handle body portion on the base for swiveling movement about a pivotal axis adjacent to said work-performing station, (e) a bend-forming shoulder disposed on and movable longitudinally along said handle body portion in directions toward and away from said pivotal axis, said shoulder being adapted for engagement with the workpiece, and (f) spring means engageable with said handle body portion and said shoulder, biasing the latter toward said pivotal axis, thereby enabling the shoulder to yield under reactive force from the workpiece, and to shift in directions away from said axis as the handle body portion is swiveled thereabout, (g) said clamping means comprising a vise having a pair of jaws, (h) one of said jaws comprising a pin carried by the base, and (i) a die carried by said pin and having lateral surface areas adapted to engage a workpiece as it is being bent, so as to impart a predetermined shape thereto, (j) part of the shoulder on said handle body portion being removable therefrom, (k) said die having means defining a recess in its lateral surface, to receive the shoulder of the handle body portion as the latter is swiveled to a predetermined position, thereby to enable the shoulder of the handle body portion to be readily removed from said recess when the handle body portion occupies said position.

25. An apparatus for bending metal parts into predetermined shapes, comprising in combination:

(a) a base, (b) clamping means on the base for holding, at a work-performing station thereon, metal shock to be bent, (c) an elongate handle, comprising a body portion, (d) means pivotally mounting the handle body portion on the base for swiveling movement about a pivotal axis adjacent to said work-performing station, (e) a bend-forming shoulder carried directly by said handle body portion and movable therewith longitudinally along the length thereof between limits, in directions toward and away from said pivotal axis, said shoulder being adapted for engagement with the workpiece, (f) spring means engageable with said handle body portion and said shoulder, biasing the latter toward said pivotal axis, thereby enabling the shoulder to yield under reactive force from the workpiece, and to shift in directions away from said axis as the handle body portion is swiveled thereabout, (g) said clamping means comprising a vise having a jaw part, (h) a face part carried by said jaw part, and (i) means removably mounting said face part on said jaw part, to permit other face parts of different configurations to be substituted therefor.

26. The invention as set forth in claim 25, wherein:

(a) one of said parts has means defining a slot, (b) the other of said parts having a tongue receivable in in said slot, (c) said mounting means comprising clamping screws for releasably securing the tongue in the slot.

* * * * *